US009131551B2

(12) United States Patent
Hovey et al.

(10) Patent No.: US 9,131,551 B2
(45) Date of Patent: Sep. 8, 2015

(54) COORDINATED VISUAL PRESENTATION USING AUDIENCE DISPLAY DEVICES

(71) Applicant: Disney Enterprises, Inc., Burbank, CA (US)

(72) Inventors: Pehr Hovey, Los Angeles, CA (US); Scott Watson, Marina Del Rey, CA (US)

(73) Assignee: Disney Enterprises, Inc., Burbank, CA (US)

( * ) Notice: Subject to any disclaimer, the term of this patent is extended or adjusted under 35 U.S.C. 154(b) by 226 days.

(21) Appl. No.: 13/901,303

(22) Filed: May 23, 2013

(65) Prior Publication Data

US 2013/0328502 A1 Dec. 12, 2013

Related U.S. Application Data

(60) Provisional application No. 61/658,268, filed on Jun. 11, 2012.

(51) Int. Cl.
*G05F 1/00* (2006.01)
*H05B 37/02* (2006.01)

(52) U.S. Cl.
CPC ..... *H05B 37/0272* (2013.01); *H05B 37/029* (2013.01)

(58) Field of Classification Search
CPC ..... G02F 1/1523; G02F 1/292; G02F 1/31; H05B 33/0815; H05B 33/0827; H05B 37/029
USPC ..... 315/297, 307, 291, 312, 299; 345/44, 345/46, 48; 709/231, 217; 362/800, 103, 362/105, 106
See application file for complete search history.

(56) References Cited

U.S. PATENT DOCUMENTS

| | | | | |
|---|---|---|---|---|
| 5,921,674 | A | 7/1999 | Koczi | |
| 7,242,152 | B2 * | 7/2007 | Dowling et al. | 315/291 |
| 7,564,426 | B2 * | 7/2009 | Poor et al. | 345/48 |
| 2002/0078221 | A1 * | 6/2002 | Blackwell et al. | 709/231 |
| 2003/0057887 | A1 * | 3/2003 | Dowling et al. | 315/291 |
| 2013/0293112 | A1 * | 11/2013 | Reed et al. | 315/131 |

OTHER PUBLICATIONS

Mouse Planet: Disney's Magical Moments pins and game. 10 pages, Dec. 9, 2011 http://www.mouseplanet.com/wdwupdate/disneys_magical_moments_pins_and_game.htm.

* cited by examiner

*Primary Examiner* — Lincoln Donovan
*Assistant Examiner* — Thomas Skibinski
(74) *Attorney, Agent, or Firm* — Farjami & Farjami LLP

(57) ABSTRACT

There is provided a system and method for a coordinated visual presentation using audience display devices. The method comprises determining a plurality of variables, wherein each of the plurality of variables include at least one process for execution by a first audience display device, determining a macro command including at least one of the plurality of variables, and transmitting the macro command for storage by the first audience display device. The method may further comprise transmitting a first trigger signal, wherein the first trigger signal includes a countdown timer for the initiating the macro command, and transmitting a second trigger signal, wherein the second trigger signal includes a second countdown timer for initiating the macro command, and wherein the second countdown timer includes the first countdown timer modified to account for a time difference between the receiving the first trigger signal and the receiving the second trigger signal.

20 Claims, 8 Drawing Sheets

COORDINATED VISUAL PRESENTATION USING AUDIENCE DISPLAY DEVICES

RELATED APPLICATIONS

The present application claims the benefit of and priority to a U.S. Provisional Patent Application Ser. No. 61/658,268, filed Jun. 11, 2012, and titled "System and Method for Producing Coordinated Shows Using Audience Display Devices," which is hereby incorporated by reference in its entirety into the present application.

BACKGROUND

Live events, such as sporting events, concerts, conventions, parades, and theme park shows, typically involve an audience passively observing a show that is produced and presented to them. In order to increase audience participation, props, signs, and devices may be distributed throughout the audience and the audience members encouraged to utilize the objects during the show. However, these objects are limited in coordination and creativity, leading to minimal audience participation and generic interactions. In other venues, electronic devices may allow audience members to send and receive information over wired or wireless communication channels. While this may lead to more in depth audience participation, the devices may be expensive or create difficulties in mass audiences where movement is common.

Stadiums, theaters, and other venues can be equipped with infrared (IR) emitters or other optical emitters. In order to provide a more specialized interaction during an event without large clunky electronic devices, audience members may wear articles of clothing, jewelry, toys, or other similar objects with lights and optical sensors that can be remotely triggered by the IR emitters. Thus, the emitters may coordinate a display of lights on the objects. However, audience members may still relocate or block an optical communication leading to inconsistencies in the presentation. Further, optical communications are typically limited in bit rate, thus limiting the functionality of the visual presentation using the object.

SUMMARY

The present disclosure is directed to a coordinated visual presentation using audience display devices, substantially as shown in and/or described in connection with at least one of the figures, as set forth more completely in the claims.

DETAILED DESCRIPTION

Figure 1:
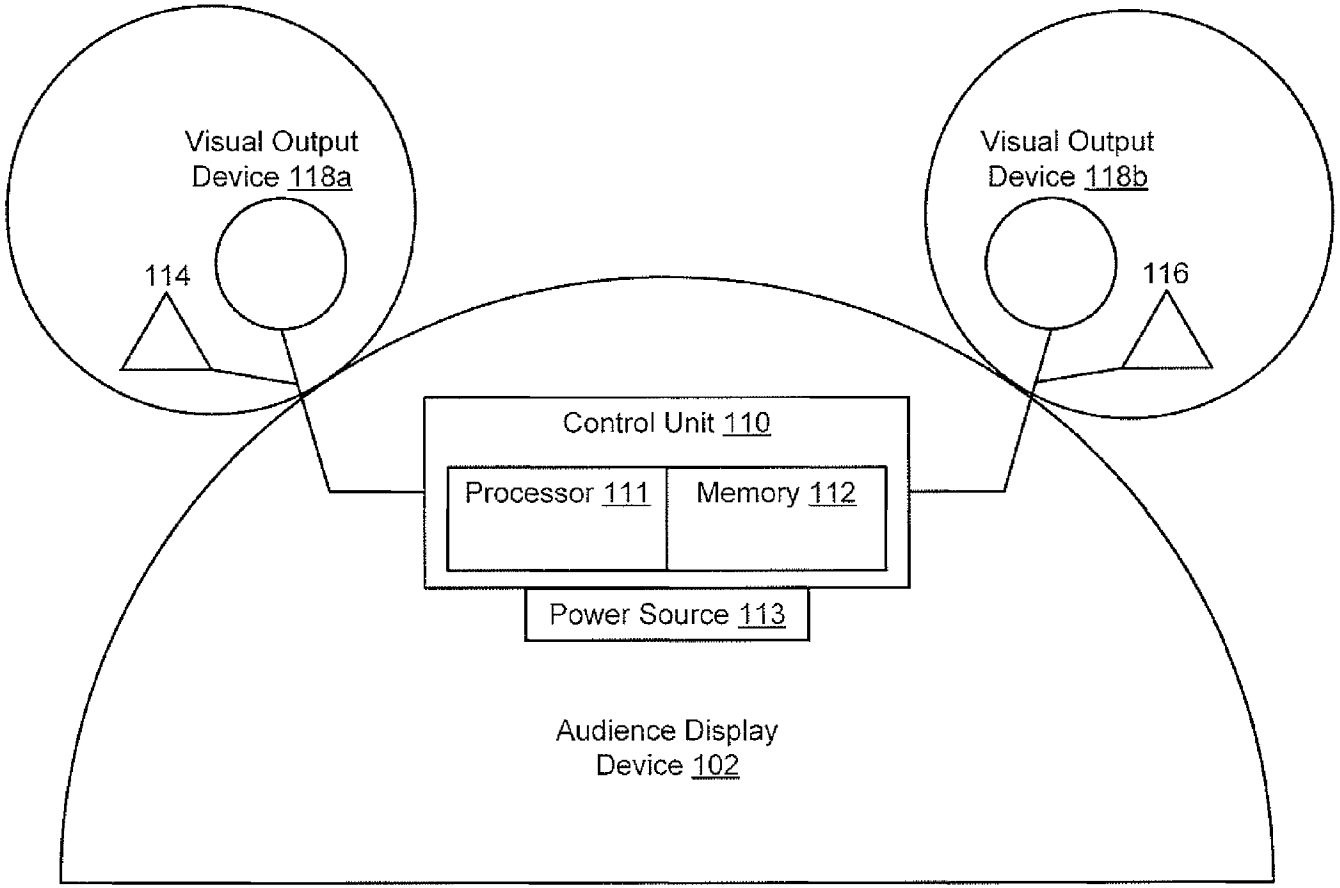
FIG. 1 presents an audience display device for use with a coordinated visual presentation.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

FIG. 1 presents an audience display device for use with a coordinated visual presentation. As shown in FIG. 1, audience display device 102 includes control unit 110 having processor 111 and memory 112, power source 113, input node 114, output node 116, visual output device 118*a* and visual output device 118*b*. As shown in FIG. 1, power source 113 is shown as attached to control unit 110. Further, control unit 110 is connected to input node 114 and is further connected to output node 116. Control unit 110 is also connected to visual output device 118*a* and 118*b*.

In the implementation of FIG. 1, audience display device 102 is shown as a hat with mouse ears. Thus, audience display device 102 may be an article of clothing that an audience member may wear. However, in other implementations, it is contemplated that audience display device 102 may be another object, such as a piece of jewelry, trinket, wand, fairy wings, or other object, clothing, or toy that an audience member may bring to an event. Therefore, the present depiction is not limiting to the physical implementation of audience display device 102.

According to FIG. 1, control unit 110 includes processor 111 and memory 112. Processor 111 may be configured to access memory 112 to store received input or to execute commands, processes, or programs stored in memory 112. Processor 111 may correspond to a processing device, such as a microprocessor or similar hardware processing device, or a plurality of hardware devices. However, in other implementations processor 111 refers to a general processor capable of performing the functions required of control unit 110. Memory 112 is a sufficient memory capable of storing commands, processes, and programs for execution by processor 111. Memory 112 may be instituted as ROM, RAM, flash memory, or any sufficient memory capable of storing a set of commands. In other implementations, memory 112 may correspond to a plurality memory types or modules. Memory 112 may also be protected to prevent outside manipulation of memory 112 or specific portions of memory 112. Memory 112 may include encryption, locks, or other mechanisms to only allow access, storage, and retrieval by authorized commands. Thus, received trigger signals and control messages may be required to meet security requirements before memory 112 may be utilized. For example, a bi-directional unlock protocol may be executed before receiving trigger signals and control messages to require that audience display device 102 is in close proximity to a device that wishes to access the secure memory. Control Messages and trigger signals will be explained in further detail in reference to FIGS. 2A and 2B below.

Thus, control unit 110 containing processor 111 and memory 112 contains sufficient memory and processing units to control the use and performance of audience display device 102. Control unit 110 is further connected to power source 113 in order to provide sufficient power to control unit 110, input node 114, output node 116, and visual output devices 118*a* and 118*b*.

Control unit 110 is connected to input node 114 in order for processor 111 to receive communications and store the communications in memory 112 or initiate a macro command by processor 111 to utilize audience display device 102. Input node 114 may include an optical sensor, such as an infrared (IR) sensor, or similar. Optical communications are capable of giving line of sight script, code, routines, or other signals that can be localized to a specific area. Thus, optical communications may be ideal in an event venue where the event coordinators wish to localize macro commands to a specific subset of the audience. However, in other implementations, input node 114 may include sensors or receptors capable of receiving radio communications, or other wireless communications. Input node 114 may also include an ambient light sensor. In such an implementation, event venue may be dark, where input node 114 may sense ambient light, such as when a spotlight shines on audience display device 102, and relay the change in ambient light to control unit 110 to cause audience display device 102 to react appropriately. Furthermore, input node 114 may include a wired connection, or port capable of receiving a wired communication. In such an implementation, input node 114 may be connected to an outside device to receive instructions on how to operate audience display device 102. For example, input node 114 may allow wired connections at a kiosk or other location at an event venue. In certain implementations, input node 114 may include a plurality of sensors, thus allowing for optical communications, radio communications, and/or wired communications.

Input node 114 thus receives communications relating to audience device 102 such as a trigger signal or a control message. As will be discussed in further detail with reference to FIG. 2A, a trigger signal may be a command including a countdown timer to execute some code and/or macro command. A control message may include a command that instructs input node 114 to save the balance of the control message as a macro command in memory 112. Additionally, a macro command may include code executable by processor 111 of audience display device 102. Such code may correspond to visual outputs on visual output devices 118*a*/118*b*. Furthermore, communications may include conditions, such as communications with if/then functionality. Audience display device 102 may then test some condition within the communication and stop execution of a command based on the result. For example, the condition could be a value of a variable or output value of a function generator, both discussed in further detail below in reference to FIGS. 2*a* and 4.

Input node 114 is connected to control unit 110. Thus, processor 111 of control unit 110 may receive the trigger signal or the control message and respond appropriately. In certain implementations, processor 111 may store this information received from input node 114 in memory 112. In other implementations, processor 111 may react to the information received from input node 114 and execute the appropriate process, such as recalling and executing a process or program stored in memory 112, or causing a visual presentation on visual output devices 118*a* and 118*b*.

Control unit 110 is further connected to output node 116. Output node 116 may correspond to a transmitter or emitter capable of relaying or outputting information or processes as required by control unit 110. In certain implementations, output node 116 may further correspond to an IR emitter, or other optical emitter. However, in other implementations, output node 116 may correspond to other output devices such as a radio emitter, or other communication emitter. Thus, output node 116 may include other output devices that may be utilized by control unit 110 to output information as required.

Control unit 110 may utilize output node 116 to output information to be received by other audience display devices or even sensors located in the event venue. Thus, output node 116 provides audience display device 102 with the ability to communicate with other devices. Communications between two audience display devices 102 or between audience display device 102 and an event venue will be discussed in more detail with reference to FIGS. 2B and 3A-B.

Audience display device 102 is shown with visual output devices 118*a* and 118*b* in FIG. 1. Visual output devices 118*a* and 118*b* may refer to a light or a light emitting diode (LED), such as a single die LED, bicolor LED, or tricolor LED. In one implementation, visual output devices 118*a* and 118*b* may refer to a red-green-blue tricolor LED or other multicolor LED capable of presenting a spectrum of visible colors. Control unit 110 may utilize visual output devices 118*a* and 118*b* to display a visual presentation according to a process executing on processor 111. While two visual display devices 118*a* and 118*b* are shown in FIG. 1, more or less visual output devices may be utilized in similar or different forms. Thus, visual output devices 118*a* and 118*b* may refer to a single visual output device or a plurality of visual output devices.

Utilizing several components of audience display device 102, control unit 110 may receive an input, such as a trigger signal or a control message and relay this information to control unit 110. Processor 111 may determine the appropriate response to the trigger signal or control message, and initiate an appropriate response, such as performing a macro command, retrieving and executing a process or program stored in memory 112, or storing the information in memory 112. Processor 111 may then utilize output node 116 and/or visual output devices 118*a* and 118*b* as necessary.

Although visual output devices 118*a* and 118*b* are shown in FIG. 1, in other implementations, audience display device 102 may include further output devices. For example, audience display device 102 may include a speaker under the control of control unit 110 to output music, speech, or other sounds as required by a process executed by processor 111. Audience display device 102 may also include a unit capable of generating a tactile sensation, such as a vibration. Thus, audience display device 102 may contain components, such as a speaker, a tactile generation module, or another module, in order to increase audience participation and create a more immersive presentation experience.

Figure 2A:
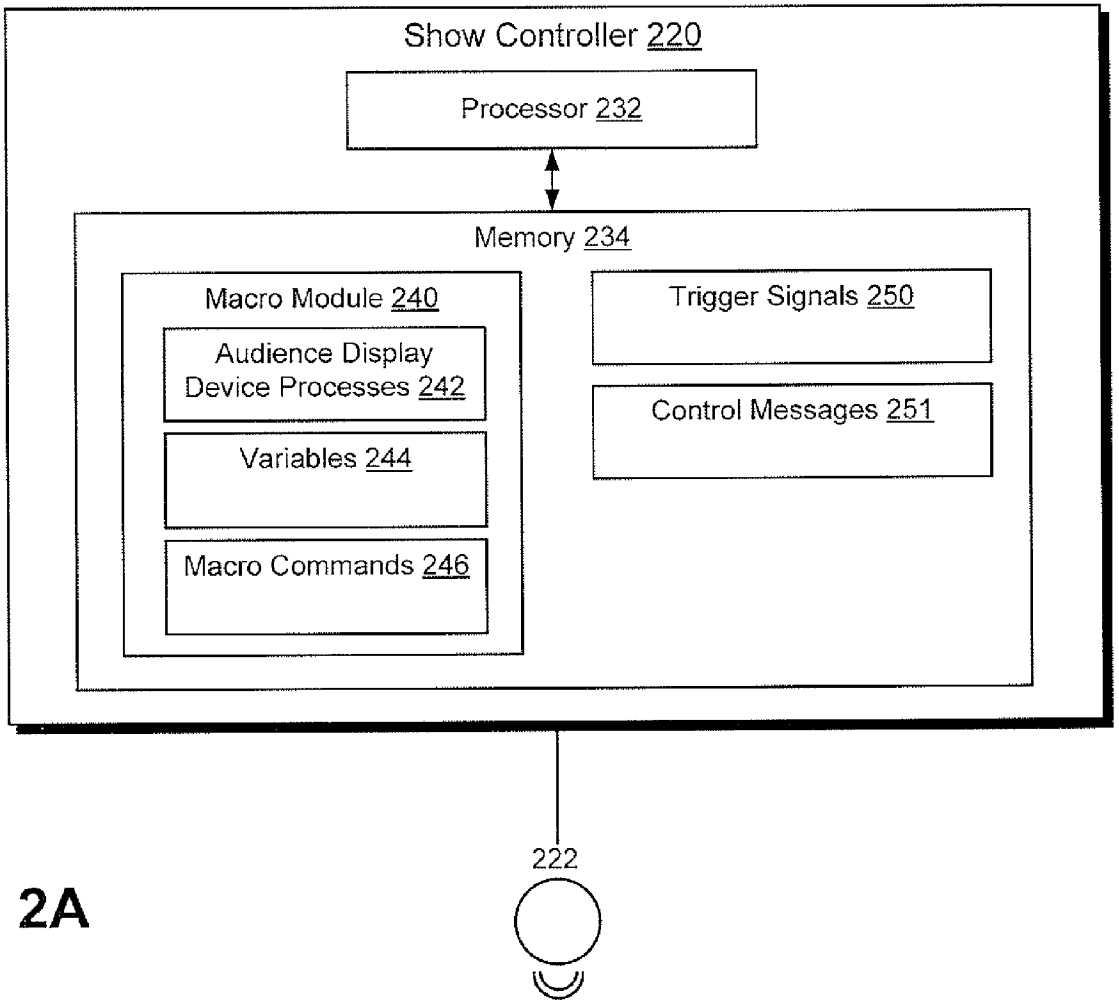
FIG. 2A presents a show controller used for a coordinated visual presentation using audience display devices.

FIG. 2A presents a show controller used for a coordinated visual presentation using audience display devices. As shown in FIG. 2A, show controller 220 includes processor 232 and memory 234. Stored on memory 234 is macro module 240 including audience display device processes 242, variables 244, and macro commands 246. Also stored in memory 234 is trigger signals 250 and control messages 251. Additionally, as shown in FIG. 2A, show controller 220 is connected to optical emitter 222.

According to FIG. 2A, show controller 220 includes processor 232, which is configured to access memory 234 to store received input and/or to execute commands, processes, or programs stored in memory 234. For example, processor 232 may receive input data corresponding to audience display device processes 242, variables 244, and/or macro commands 246, and store the data in memory 234. Processor 232 may also access memory 234 and execute programs, processes, and modules stored in memory 234, such as macro module 240, or retrieve data such as audience display device processes 242, variables 244, macro commands 246, trigger signals 250, and/or control messages 251. Additionally, processor 232 may store in memory 234 data resulting from executed programs, processes and modules. Processor 232 may correspond to a processing device, such as a microprocessor or similar hardware processing device, or a plurality of hardware devices. However, in other implementations, processor 232 refers to a general processor capable of performing the functions required by show controller 220. For example, processor 232 may correspond to a plurality of processors.

Memory 234 of show controller 220 corresponds to a sufficient memory capable of storing commands, processes, and programs for execution by processor 232. Memory 234 may be instituted as ROM, RAM, flash memory, or any sufficient memory capable of storing a set of commands. In other implementations, memory 234 may correspond to a plurality memory types or modules. Thus, processor 232 and memory 234 contains sufficient memory and processing units necessary for show controller 220. Although memory 234 is shown as located on show controller 220, in other implementations, memory 234 may be separate but connectable to show controller 220.

Processor 232 accesses memory 234 in order to run macro module 240. Macro module 240 may correspond to an application capable of creating one or a plurality of macro commands 246 for execution by an audience display device. For example, macro commands 246 may include instructions for execution by the audience display device. In one specific implementation, one of macro commands 246 may include a progression of light displays for a visual output device of the audience display device that coordinates the visual output device with a show or event. In such an implementation, the one of macro commands 246 may correspond to a substantial set of precise instructions that would otherwise be difficult to transmit immediately. Thus, macro commands 246 may be transmitted prior to the show or event proceeding and stored on the audience display device for later recall.

Macro module 240 further contains variables 244. Variables 244 may correspond to one or a plurality of identifying executable codes. Each of variables 244 may identify a process or a set of processes executable by a control module of an audience display device. Thus, a variable of variables 244 may correspond to specific instructions, such as lighting the a visual output device of an audience display device with white light for 5 seconds and fading the light to off over 3 seconds. Each variable of variables 244 may be determined and designated by macro module 240 of show controller 220. Thus, when macro module 240 is executed by processor 232, macro modules 240 may utilize variables 244 when creating macro commands 246.

Variables 244 may further be linked to the input of function generators, which are discussed in further detail below in reference to FIG. 4. For example, a variable V1 can be set using a directional transmission, varying a command such that a variable V1 is set to 0.0 seconds on the far left of the audience, 0.5 seconds in the middle of the audience, and 1.0 seconds on the far right of the audience. V1 can then be attached to the phase-offset input of a function generator, e.g. A SIN function, that is running relative to an internal clock. Finally, a global message may be sent out to reset a local clock of all the audience display devices to 0.0 seconds, thus, resulting in a pulsing wave of brightness across the audience.

Macro module 240 contains a list of all processes and procedures executable by an audience display device in audience display device processes 242. Audience display device processes 242 may contain coding for a control module of an audience display device. For example, audience display device processes 242 may contain the executable code that instructs the control module to behave in a specific manner, such as a sine wave generator, light coloring, light intensity, or other behavior. Audience display device processes 242 may be programmable through user input. Audience display device processes may be referenced by variables 244 when creating macro commands 246.

Memory 244 of show controller 220 also contains trigger signals 250. Trigger signals 250 may correspond to one or a plurality of executable commands, processes, or procedures receivable by an audience display device. Trigger signals 250 may include a command to run one or a plurality of macro commands 246 saved on the audience display device. Trigger signals 250 may further include instructions to run the one or a plurality of macro commands 246 after a certain time period or with a specific delay, such as a countdown timer. For example, one of trigger signals 250 may include data corresponding to a command to run one of macro commands 246 after a 10 second delay from receiving the one of trigger signals 250. Thus, after 10 seconds, all audience display devices receiving the one of trigger signals 250 will display the one of macro commands 246 at the same time, leading to a coordinated visual presentation using the audience display devices.

Additionally, in situations where the first one of trigger signals 250 may not be received, such as by a new participant in an event or a miscommunication, a second one of trigger signals 250 may be utilized. The second one of trigger signals 250 may include a countdown timer accounting for a time difference in transmission of the first one of trigger signals 250 and the second one of trigger signals 250. For example, show controller 220 may transmit the first one of trigger signals 250 with a 10 second countdown timer as described above. Additionally, show controller 220 may transmit the second one of trigger signals 250 5 seconds later with a 5 second countdown timer instructing audience display devices to perform the same one of macro commands 246. Thus, audience display devices not receiving the first one of trigger signals 250 will still be instructed to perform the correct one of macro commands 246 at the same time by receiving the second one of trigger signals 250. The second one of trigger signals 250 may further contain an overwrite or supersede command.

Memory 244 of show controller 220 also contains control messages 251. Control messages 251 may correspond to one of a plurality of executable commands, processes, or procedures receivable by an audience display device. Control messages 251 may include a command that instructs the audience display device to save the balance of the control message as macro command 246 for later retrieval. Control messages 251 may further include commands to execute a previously stored macro command 246 or execute a macro command 246 included in the control message when the audience display device receives the control message. Furthermore, control messages 251 may reference and/or set variables transmitted to the audience display device.

Figure 2B:
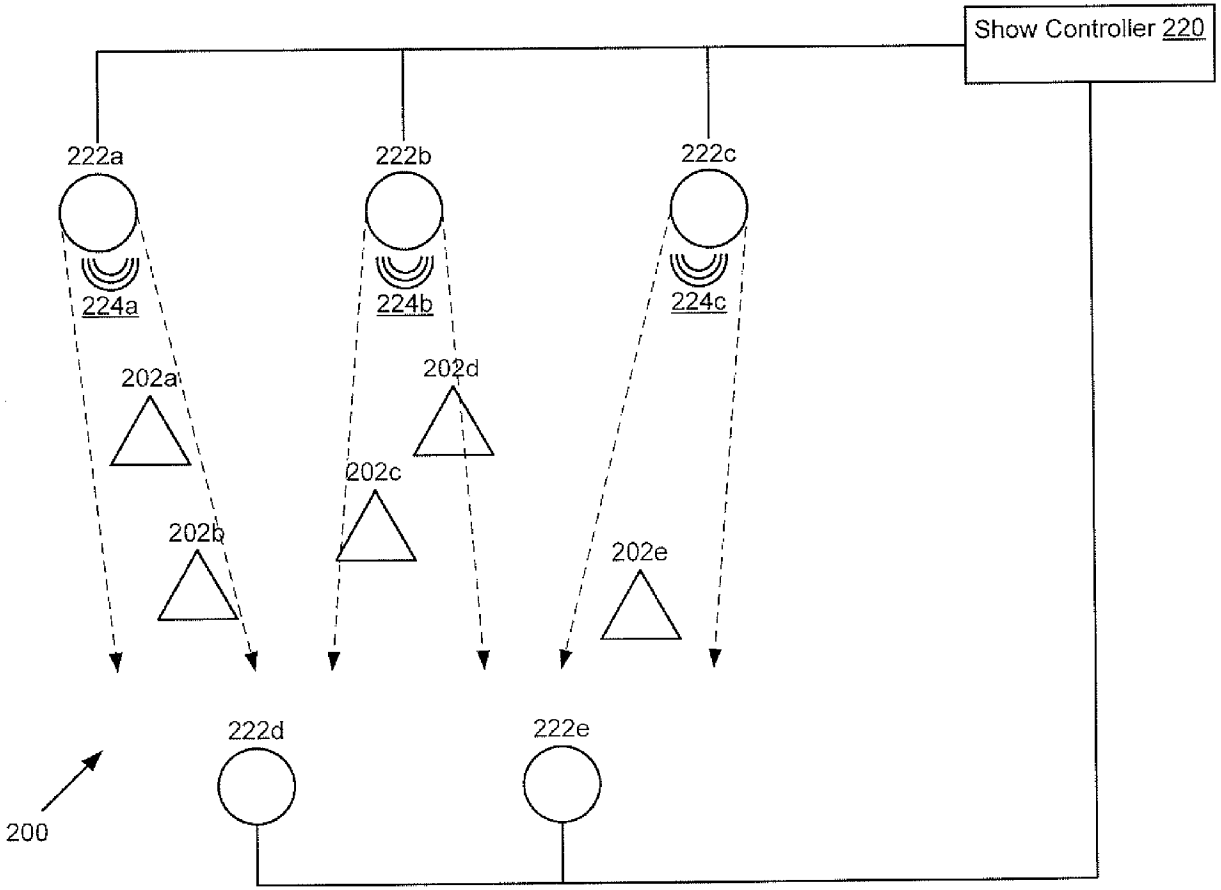
FIG. 2B presents an exemplary event environment with a coordinated visual presentation using audience display devices.

Thus, as described above, show controller 220 may create macro commands 246 for transmission to an audience display device. Show controller 220 of FIG. 2A is also connected to optical emitter 222. Optical emitter 222 allows for transmission of macro commands 246 to an audience display device using control messages 251. Optical emitter 222 may also transmit trigger signals 250 to the audience display device. As will be explained in further detail with reference to FIG. 2B, show controller 220 may utilize optical emitter 222 to preload the audience display device with macro commands 246 and recall the macro commands for simultaneous execution using trigger signals 250. Optical emitter 222 may correspond to an infrared transmitter capable of transmitting line of sight communications. However, in other implementations, other emitters may be used, such as radio, wireless, or any type of emitter capable of transferring data to an audience display device.

Moving to FIG. 2B, FIG. 2B presents an exemplary event environment with a coordinated visual presentation using audience display devices. Event environment 200 is shown with audience display device 202*a*, audience display device 202*b*, audience display device 202*c*, audience display device 202*d*, and audience display device 202*e* experiencing an event in event environment 200. Although five audience display devices are shown in FIG. 2B, it is understood event environment 200 may contain more or less. Also shown in FIG. 2B is show control 220 with optical emitter 222*a*, optical emitter 222*b*, optical emitter 222*c*, optical emitter 222*d*, and optical emitter 222*e*. Optical emitter 222*a* is shown broadcasting event communication 224*a*, optical emitter 222*b* is shown broadcasting event communication 224*b*, and optical emitter 222*c* is shown broadcasting event communication 224*c*. Furthermore, although five optical emitters are shown in FIG. 2B, it is understood more or less may be utilized in event environment 200.

As shown in FIG. 2B, audience display devices 202*a-e* are distributed throughout event environment 200. This may be representative of audience members wearing or holding audience display devices 202*a-e* during a performance in event environment 200. As discussed with reference to FIG. 2A, performers and/or administrators of the event occurring in event environment 200 may utilize show controller 220 to coordinate a visual presentation using audience display devices 202*a-e*. Show controller 220 may be programmed with a specific visual presentation for audience display devices 202*a-e*, or may contain appropriate controls for the performers of the event to manipulate as the event unfolds.

Show controller 220 may correspond to an appropriate devices and procedures to determine a set of variables that include at least one processes for execution by audience display devices 202*a-e*. Show controller 220 may further create a macro command containing at least one variable of the set of variables. Thus, show controller 220 may determine a macro command containing one or more variables. For example, the macro command may include variable A followed by variable B. Thus, the macro command may instruct audience display devices 202*a-e* to utilize variable A followed by variable B. Moreover, as discussed with reference to FIG. 2A, show controller 220 may transmit the macro commands using control messages for storage by audience display devices 202*a-e*. In such an implementation, show controller 220 may further utilize trigger signals as discussed above to execute the macro commands at specific desired times and in coordination with audience display devices 202*a-e*.

As shown in FIG. 2B, show controller 220 is utilizing optical emitters 222*a*, 222*b*, and 222*c*. Thus, optical emitter 222*a* is shown emitting event communication 224*a*, optical emitter 222*b* is shown emitting event communication 224*b*, and optical emitter 222*c* is shown emitting event communication 224*c*. Event communication 224*a-c* may correspond to an optical communication, such as a trigger signal or a control message. Each of event communication 224*a-c* may correspond to the same or different trigger signal or control message as required by show controller 220. Thus, optical emitters 222*a-c* may correspond to optical or IR emitters transmitting line of sight optical communications as event communications 224*a-c* to audience display devices 202*a*, 202*b*, 202*c*, 202*d*, and 202*e* in their respective areas covered by optical transmitters 222*a-c*. Show controller 220 is shown not utilizing optical emitter 222*d* and 222*e*. This may occur to limit the distribution of event communications 224*a-c*, in order to achieve the desired visual effect. Thus, shown controller 220 may decide which of optical emitters 222*a-e* to use to achieve a coordinated visual presentation as desired.

As shown in FIG. 2B, event communications 224*a-c* are limited to a specific area. Thus, show controller 220 is able to localize event communications 224*a-c* to a specific area. This allows event communications 224*a-c* to each correspond to a different trigger signal or control message. Thus, show controller 220 may determine each section of the audience containing audience display devices 202*a-e* receives different trigger signals and/or control messages to create a desired coordinated visual presentation throughout the audience.

During an event shown in event environment 200, there may be periods where show controller 220 can load processes to be performed at some future time based on a macro command. For example, prior to the event beginning, show controller 220 may desire audience display devices in the area covered by optical emitter 222*a* to have a sine wave generator in order to display a palette of colors in a rolling sine wave. If audience display devices 202*a* and 202*b* do not have a sine wave generator previously stored, show controller may use optical emitter 222*a* to broadcast event communication 224*a* with the appropriate sine wave generator process as a macro command using control messages. Show controller 220 may continue to broadcast this for an amount of time, up to and including the beginning of the event, in order to achieve sufficient coverage of audience display devices 202*a* and 202*b*. Show controller 220 may quickly recall the sine wave generator process during the event by recalling the designated macro command using control messages. Thus, when show controller 220 desires during the event, show controller 220 may broadcast the control message or a trigger signal with a countdown to the macro command in order to initiate the stored sine wave generator process on audience display devices 202*a* and 202*b*.

As previously discussed, by utilizing trigger signals with countdown timers, show controller is able to instruct audience display devices 202*a-e* to perform a macro command at some future time. This allows show controller 220 to preload audience display devices with macro commands. Thus, show controller 220 may utilize optical emitters 222*a-e* to transmit one or a plurality of macro commands using control messages prior to use of the one or a plurality of macro commands by audience display devices 202*a-e* in event environment 200, and for storage by audience display devices 202*a-e*. This may be necessary to load audience display devices 202*a-e* with one or a plurality of macro commands that contain a large amount of data, such as the previously discussed sine wave generator. Additionally, in order to obtain more complete coverage when audience display devices 202*a-e* are mobile or prone to inaccessibility, show controller 220 may retransmit the macro commands using control messages as many times as necessary or desired. In other implementations, macro commands may be stored on audience display devices 202*a-e* through other means, such as factory preloading, a kiosk, or different optical emitters throughout a venue.

During an event in event environment 200, show controller 220 may utilize event communications 224*a-c* to transmit trigger signals corresponding to execution of one or a plurality of stored macro commands in audience display devices 202*a-e*. Event communications may correspond to the same trigger signal or a plurality of trigger signals each with separate countdown timers, as previously discussed. Show controller 220 may retransmit or rebroadcast the trigger signals as necessary in order to obtain complete coverage. For example, audience members utilizing audience display devices 202*a-e* may move to new sections or may not receive the initial trigger signal. Thus, show controller 220 may obtain more complete coverage and reach devices that didn't initially receive the trigger signals by rebroadcasting the trigger signal a number of times. However, show controller 220 may modify the trigger signals in event communications 224*a-c* to account for the time different between the initial broadcast of event communication 224*a-c* and the n-th broadcast of event communication 224*a-c*, as previously discussed.

As an example of the above implementation, event communication 224*a* may correspond to a trigger signal with a 10 second countdown until initiation of an macro command stored in a memory of audience display devices 202*a* and 202*b*. Audience display device 202*a* may receive the initial event communication 224*a*, however as seen in FIG. 2B, audience display device 202*b* may be behind audience display device 202*a* and not receive event communication 224*a* initially. Thus, show controller 220 may utilize optical transmitter 222*a* to rebroadcast event communication 224*a* with a new trigger signal, however the new trigger signal may account for the time difference between the initial broadcast and the rebroadcast. If, during the rebroadcast, audience display device 202*b* moves sufficiently to receive the rebroadcast containing the new trigger signal, audience display device 202*b* now will initiate the macro command at the same time as audience display device 202*a*.

Additionally, event communication 224*b* may also correspond to another trigger signal. However, audience display devices 202*c* and 202*d* are in sufficient coverage to pick up the initial broadcast of event communication 224*b* and similarly will execute their macro command at the end of their trigger signal. In addition, if one of audience display devices 202*a-e* move to a different area of the audience covered by a different event communication 224*a-c*, the one of audience display device 202*a-e* that moved will receive the trigger signal for the appropriate area by receiving the broadcast or rebroadcast of event communication 224*a-c* corresponding to the area. For example, subsequently rebroadcast trigger signals may be given a higher priority, overwrite command, or other superseding instructions over previous trigger signals in order to reset the trigger signal on audience display device 202*a-e* that moved to the area.

In another implementation, event communications 224*a-c* may include different messages containing processes for immediate execution by audience display device 202*a-e*. This may occur for basic commands or when show controller 220 does not have sufficient tune until execution of the process to broadcast a full control message and/or a trigger signal with a countdown. For example, the message may include a process to display a certain color for a period of time. Event communication 224*a* may communicate that blue is to display for 5 seconds, while event communication 224*b* corresponds to white for 5 seconds, and event communication 224*c* corresponds to red for 5 seconds. Thus, each section of the audience may display a separate color on audience display devices 202*a-e* as desired by show controller 220 to create the appropriate visual presentation.

In order to further coordinate the visual presentation when using basic commands, show controller 220 may rebroadcast event communication 224*a-c* during the visual presentation. In the above example where a color is displayed for 5 seconds, show controller 220 may decrease the time to display the color in the message to account for the time difference between the initial broadcast and the rebroadcast. Thus, if the rebroadcast occurs n seconds later, the rebroadcast will contain an message containing a process to display the color to 5−n seconds. In this manner, an audience display device, such as audience display device 202*b* behind audience display device 202*a*, which does not receive the initial broadcast of event communication 224*a-c* may receive the rebroadcast. In addition, if one of audience display devices 202*a-e* move to a different area of the audience covered by a different event communication 224*a-c*, the one of audience display device 202*a-e* that moved will display the color for the appropriate area.

Figure 3A:
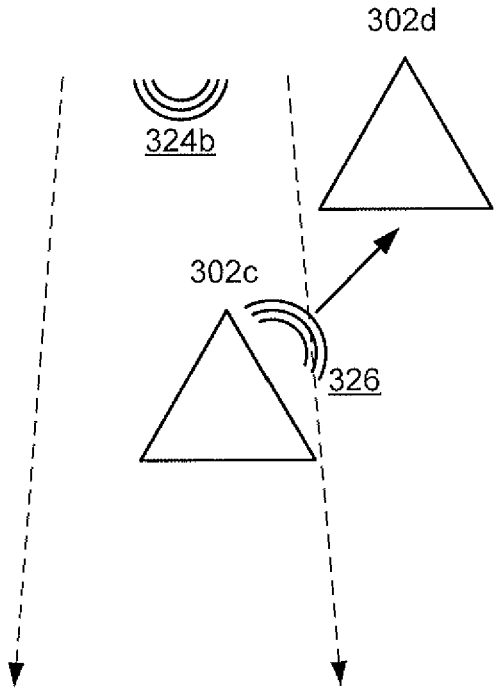
FIG. 3A shows one audience display device communicating with another audience display device during an event.

Referring now to FIG. 3A, FIG. 3A shows one audience display device communicating with another audience display device during an event. FIG. 3A includes audience display device 302*c* receiving event communication 324*b*. Further shown in FIG. 3A is audience display device 302*c* broadcasting coordination communication 326, which is received by audience display device 302*d* outside of the area of event communication 324*b*. Although two audience display devices are shown in FIG. 3A, it is understood more or less may be perform this action. Thus, one or a plurality of audience display devices may receive event communication 324*b* and broadcast coordination communication 326 and one or a plurality of audience display devices may receive coordination communication 326.

As shown in FIG. 3A, audience display device 302*c* may receive event communication 324*b*. This may correspond to audience display device 202*c* and event communication 224*b* in FIG. 2B. However, in FIG. 2B, audience display device 202*d* also receives event communication 224*b*. In contrast to FIG. 2B, audience display device 302*d* is no longer in the zone covered by event communication 324*b*. This may occur if the audience member with audience display device 302*d* moves out of the zone covered by event communication 324*b* into an area not covered by an event communication, or if audience display device 302*d* is blocked by some object or person. Thus, in FIG. 3A, audience display device 302*d* is not receiving event communication 224*b*.

In order to better coordinate a visual presentation under these circumstances, audience display device 302*c* is implemented with an output node, such as output node 116 of FIG. 1. The output node may correspond to a short-range radio transmitter or optical emitter. Thus, after receiving event communication 324*b*, audience display device 302*c* may assist a show controller in coordinating the visual presentation by broadcasting coordination communication 326. Coordination communication 326 corresponds to event communication 324*b* and may either be an exact rebroadcast of event communication 324*b* or a modification of event communication 324*b*. For example, immediately after receiving event communication 324*b*, audience display device 302*c* may rebroadcast event communication 324*b* as coordination communication 326 so that audience device 302*d* immediately receives the information contained in event communication 324*b*. However, in another implementation, audience display device 302*c* may modify event communication 324*b*, such as to account for a time delay in rebroadcasting event communication 324*b*. Thus, coordination communication 326 may include a modified version of event communication 324*b*. In either implementation, coordination communication is broadcast by audience display device 302*c* so that audience display device 302*d* receives coordination communication 326 and performs the same or similar process as audience display device 302*c*.

As examples of the above implementations, audience display device 302*c* may receive a command message that includes a command to store a macro command in event communication 324*b* prior to an event occurring, such as loading of a specific set of instructions for execution by audience display device 302*c*. However, audience display device 302*d* has not yet received the control message from event communication 324*b*, and thus will not perform the macro command when recalled during the event. Thus, audience display device 302*c* rebroadcasts the same control message as coordinate communication 326 that is received by audience display device 302*d*. In this example, audience display device 302*d* will then have to correct macro command to recall during the event.

In another implementation, event communication 324*b* may correspond to a trigger signal occurring during an event, and used to recall a previously stored macro command. For example, event communication 324*b* may correspond to a trigger signal with a 5 second countdown to initiating a macro command. In such an implementation, only audience display device 302*c* receives the trigger signal from event communication 324*b*. However, utilizing an output module, audience display device transmits coordination communication 326 to audience display device 302*d*, thus providing audience display device 302*d* with the correct trigger signal. However, due to delays or subsequent rebroadcasts, the trigger signal may be modified to account for a time difference between event communication 324*b* and coordination communication 326.

Figure 3B:
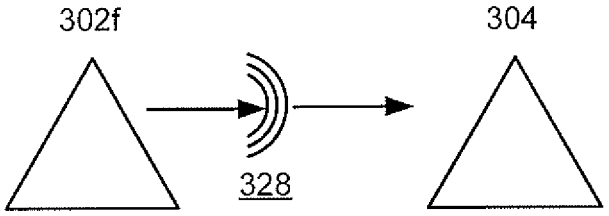
FIG. 3B shows one audience display device coordinating a personalized display with a receptor.

Moving to FIG. 3B, FIG. 3B shows one audience display device coordinating a personalized display with a receptor. As shown in FIG. 3B, audience display device 302*f* broadcasts personalized communication 328 to receptor 304. Although one audience display device and one receptor are shown in FIG. 3B, it is understood more or less may be utilized. Thus, one or a plurality of audience display devices may broadcast personalized communication 328 and one or a plurality of receptors may receive personalized communication 328.

Audience display device 302*f* is shown broadcasting personalized communication 328. Audience display device 302*f* may be personalized to the audience member possessing audience display device 302*f*, such as through the use of serial numbers and/or user registration. In one implementation, the audience member possessing audience display device 302*f* may have a birthday. Thus, audience display device 302*f* may be programmed with information of the audience member's birthday. For example, the audience member may program a birth date value, corresponding to the audience member's birthday, in secure memory of audience display device 302*f*, such as memory 112. The audience member may program audience display device 302*f* with this information by utilizing a kiosk or an input node, such as input node 114 of FIG. 1, on audience display device 302*f*. Furthermore, a venue may be set up with emitters to broadcast the birthdays and the corresponding serial or identifying number of audience display device 302*f* to otherwise program audience display device 302*f*.

In such an implementation, audience display device 302*f* may react accordingly, such as displaying a visual presentation corresponding to a birthday celebration. In one implementation, a message may be broadcast that contains the current date and one behavior for audience display device 302*f* to execute if the audience member's birthday matches the current date, or is within a set range of days to the current date. Further, audience display device 302*f* may broadcast personalized communication 328, communicating that it is the audience member's birthday that possesses audience display device 302*f*. Personalized communication 328 may correspond to a trigger signal, control message, or even identifying message and/or code. When personalized communication 328 corresponds to a trigger signal, personalized communication 328 may include a countdown timer or synchronizing message to coordinate a macro command with a receiving unit. However, in other implementations, personalized communication 328 may correspond to a control message for storage and/or execution of a macro command by the receiving unit. Further, personalized communication may correspond to an identifying message and/or code, such as a serial number, identifier, or saved personalized data of audience display device 302*f*.

In response, receptor 304 may receive personalized communication 328 and react appropriately. In one implementation, receptor 304 is another audience display device. However, receptor 304 may be any type of receptor. For example, receptor 304 may include performers in an event, performers in a theme park, or locations in a venue. In such implementations, the performers or locations may receive personalized communication 328 and react, such as by exclaiming "Happy Birthday!" or by including the audience member in the event. In addition, the location in the venue may offer free or discounted services, or may incorporate the audience member in a rewards system, such as receiving points or "Kudos."

In another implementation, audience display device 302*f* may correspond to one audience member in a group of other audience members. Thus, the audience members may register their audience display device as a group including audience display device 302*f*. In such an implementation, receptor 304 may correspond to an audience display device of a member of the group. Thus, audience display device 302*f* may broadcast personalized communication 328, which is received by receptor 304 corresponding to the audience display device of the member of the group. Audience display device 302*f* and receptor 304 may then coordinate a presentation to identify the two audience members as part of the same group. For example, the group may set green as an identifying color to flash when near each other. Thus, when audience display device 302*f* broadcasts personalized communication 328 and it is received by receptor 304 corresponding to the audience display device of the member of the group, receptor 304 may flash green.

Due to personalized communications 328, audience display device 302*f* and/or receptor 304 may receiving conflicting information, such as an event communication and personalized communication 328 each including a different trigger signal, control message, and/or identifying code. Therefore, audience display device 302*f* may prioritize received trigger signals, control messages, and/or identifying code. Based on the received trigger signal, control message, and/or identifying code, audience display device 302*f* may react different. For example, an event communication, such as event communication 224*a-c* of FIG. 2B, may be prioritized over personalized communication 328. Thus, during an event, audience display device 302*f* and/or receptor 304 will coordinate with the event communication. In another implementation, a superseding or overriding "shut off" command may be broadcast, where audience display device 302*f* and/or receptor 304 will terminate all processes executing at the time and turn off. This may be utilized during a dark period of the event, or if audience display device 302*f* and/or receptor 304 are brought into a dark area, such as a theme park ride.

Figure 3C:
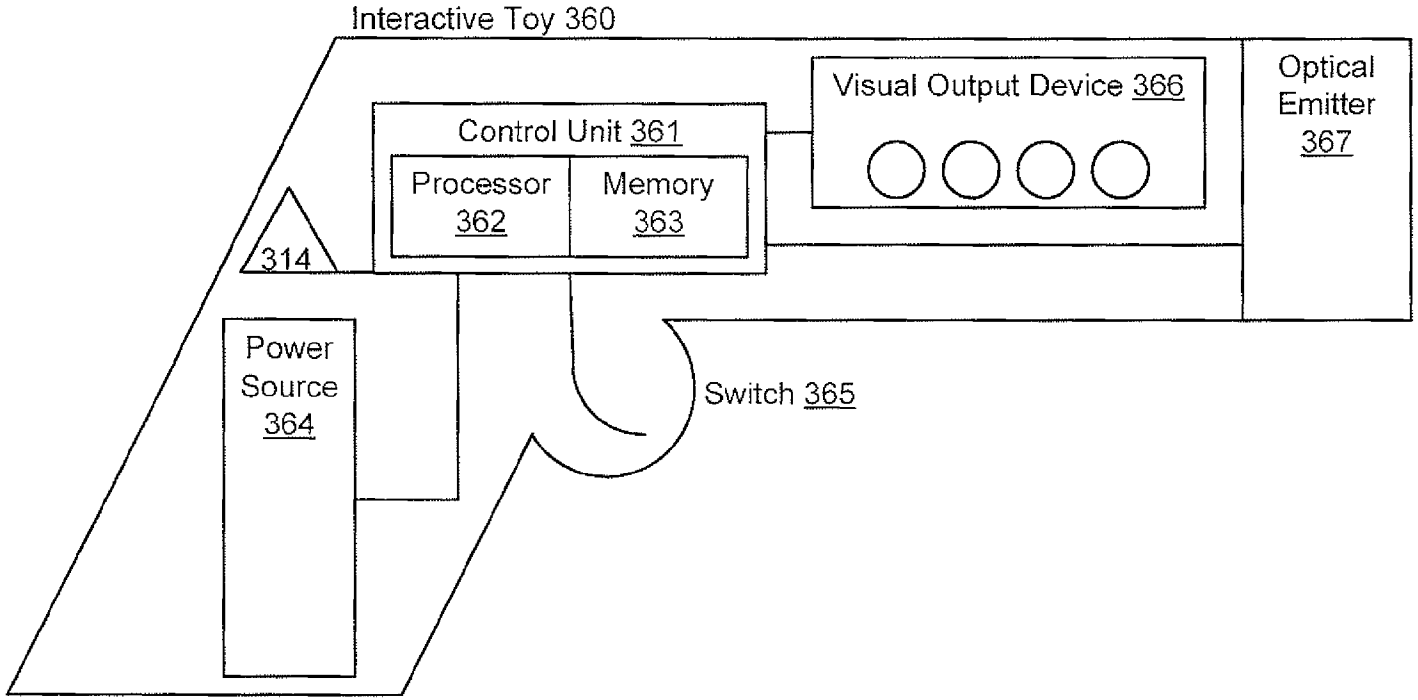
FIG. 3C shows a toy for use with an audience display device to present a coordinated visual presentation.

FIG. 3C shows a toy for use with an audience display device to present a coordinated visual presentation. As shown in FIG. 3C, interactive toy 360 includes control unit 361 having processor 362 and memory 363. Control unit 361 is further connected to input node 314, switch 365, visual output device 366 and optical emitter 367. Further, control unit 361 is connected to power source 364 in order to provide power for control 361, visual output device 366, and optical emitter 367.

As shown in FIG. 3C, interactive toy 360 includes control unit 361 having processor 362 and memory 363. Processor 362 may be configured to access memory 363 to store received input or to execute commands, processes, or programs stored in memory 363. Processor 362 may correspond to a processing device, such as a microprocessor or similar hardware processing device, or a plurality of hardware devices. However, in other implementations processor 362 refers to a general processor capable of performing the functions required of control unit 361. Memory 363 is a sufficient memory capable of storing commands, processes, and programs for execution by processor 362. Memory 363 may be instituted as ROM, RAM, flash memory, or any sufficient memory capable of storing a set of commands. In other implementations, memory 363 may correspond to a plurality memory types or modules. Memory 363 may also be protected to prevent outside manipulation of memory 363 or specific portions of memory 363. Memory 363 may include encryption, locks, or other mechanisms to only allow access, storage, and retrieval by authorized commands.

Control unit 361 is further connected to power source 364. Power source 364 may be configured provide sufficient power to control unit 361, visual output device 366, and optical emitter 367.

In one implementation, interactive toy 360 functions just like the audience display device, such as audience display device 102. However, interactive toy 360 further includes switch 365, which may cause interactive toy 360 to transmit one or a plurality of messages to control an interactive device or other receptor, as explained in more detail below. In other implementations, interactive toy 360 may not be able to receive commands and is only be able to transmit the one or the plurality of messages to control the interactive device or the other receptor. In such an implementation, interactive toy 360 is not under show control.

A user of interactive toy 360 may utilize switch 365 with interactive toy 360, such as by pulling a trigger, or otherwise engaging switch 365. Switch 365 may send an input signal to control unit 361, causing processor 362 to access memory 363 and execute the appropriate action. For example, in one implementation, switch 365 may activate visual output device 366, such as by causing lights on visual output device 366 to flash. Additionally, a sound module may be included that creates a noise when switch 365 is engaged.

Switch 365 may cause control unit to utilize optical emitter 367 when engaged. Memory 363 may include trigger signals and/or control messages. When switch 365 is engaged, processor 362 may access memory 363 to determine a trigger signal and/or control message to utilize. Processor 362 of control unit 361 may then utilize optical emitter 367 to transmit the trigger signal and/or control message, such as by infrared signal. Thus, interactive toy 360 may be capable of transmitting a trigger signal and/or control message to an audience display device or other receptor for interaction and a coordinated visual presentation. For example, switch 365 may transmit a trigger signal to execute a stored macro command on the audience display device to control the audience display device, such as lighting up the ears on the audience display device.

Figure 4:
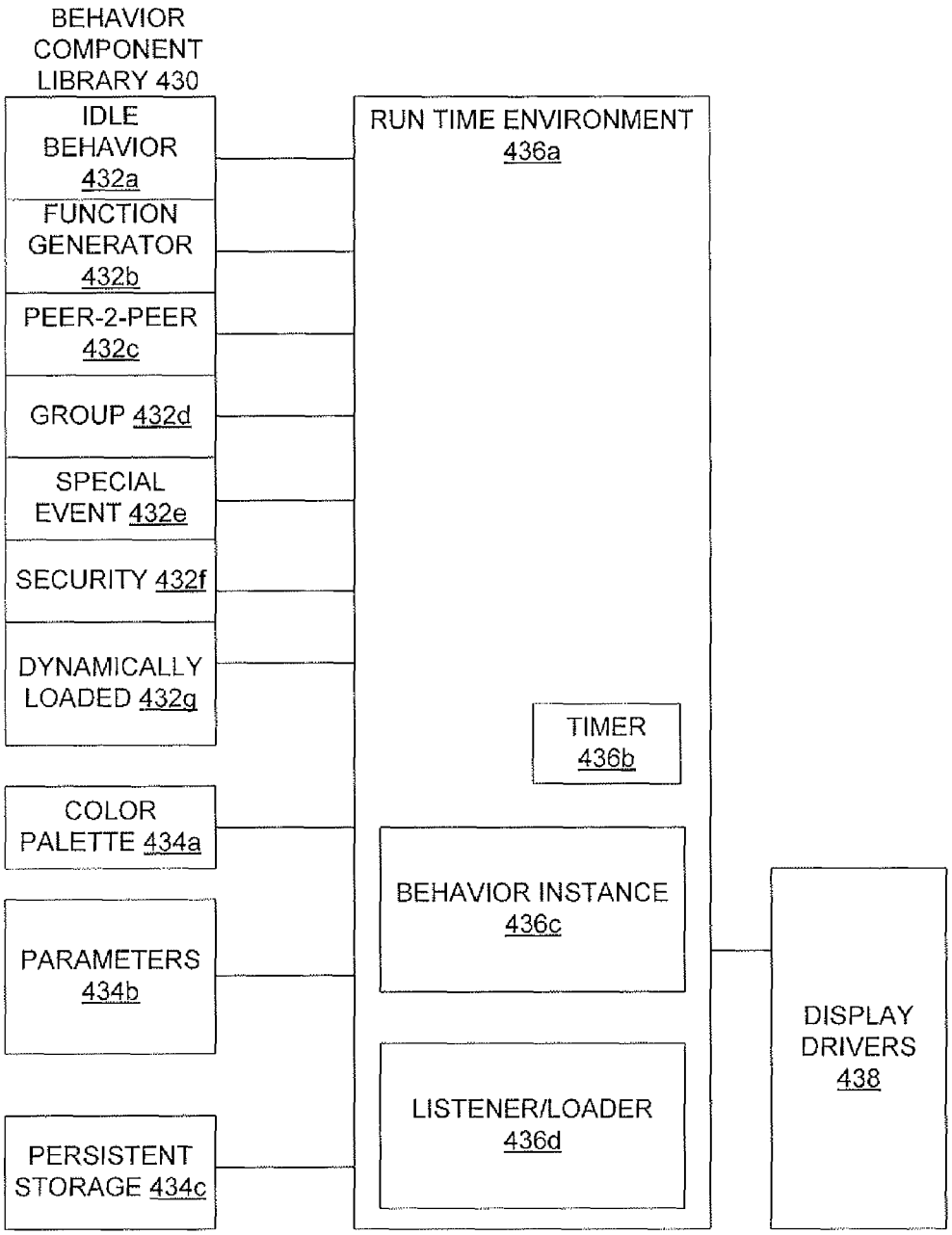
FIG. 4 presents an exemplary runtime environment of an audience display device for coordinating a visual presentation.

Referring now to FIG. 4, FIG. 4 presents an exemplary runtime environment of an audience display device for coordinating a visual presentation. As shown in FIG. 4, behavior component library 430 includes coded behaviors executable for a visual display using an audience display device. The behaviors included in behavior component library 430 include idle behavior 432*a*, function generator 432*b*, peer-2-peer 432*c*, group 432*d*, special event 432*e*, security 432*f*, and dynamically loaded 432*g*. Further, in order to execute behavior component library 430, FIG. 4 includes color palette 434*a* and parameters 434*b*. FIG. 4 also includes persistent storage 434*c*. FIG. 4 includes run time environment 436*a* utilizing behavior component library 430, color palette 434*a*, parameters 434*b*, and persistent storage 434*c*. Run time environment 436*a* includes timer 436*b*, behavior instance 436*c*, and listener/loader 436*d*. Run time environment 436*a* further accesses display drivers 438 in order to interact with hardware components of the audience display device.

As shown in FIG. 4, run time environment 436*a* includes timer 436*b*, behavior instance 436*c* and listener/loader 436*d*. Run time environment 436*a* continuously or periodically listens to input devices and receives messages and commands to execute a desired behavior. Based on an incoming trigger signal or control message, run time environment 436*a* may determine timer 436*b* and behavior instance 436*c*. For example, run time environment 436*a* may receive a trigger signal with a countdown timer. Furthermore, the trigger signal may include a desired behavior, such as a macro command to implement. In another implementation, run time environment 436*a* may receive a message to begin a specific behavior immediately, as previously discussed.

Behavior component library 430 includes some persistently stored processes that institute a behavior utilized for behavior instance 436*c*. For example, idle behavior 432*a* may correspond to a general idle behavior performed on all audience display devices when no information is received by the audience display device. Thus, run time environment 436*a* may institute idle behavior 432*a* at start up or during idle. In another implementation, run time environment 436*a* may utilize function generator 432*b*, such as a sine wave generator, for the desired behavior. Peer-2-peer 432*c* may synchronize between two or more audience devices communicating together, or some other peer behavior. Group 432*d* may correspond to set group commands so that run time environment 436*a* only accepts commands from a preset group of audience display devices. Special event 432*e* may include processes to use for birthdays, weddings, anniversaries, holidays, or similar events. Security 432*f* may include processes to use for security measures, such as lost hats or separated audience members possessing the audience display device. In addition, listener/loader 436*d* of run time environment 436*a* may dynamically load instructions, commands, and processes into dynamically loaded 432*g*. For example, an audience display device may receive control messages that include a command to store macro commands for later execution by the audience display device, as previously discussed. Listener/loader 436*d* may load the macro command into dynamically loaded 432*g*. Dynamically loaded 432*g* may then contain updated macro commands that can be recalled using a designation of the macro command.

As previously discussed, rim time environment 436*a* can also access stored information, such as color palette 434*a*, parameters 434*b*, and persistent storage 434*c*. Color palette 434*a* may contain information sufficient to display the appropriate colors on a visual output device of an audience display device. Parameters 434*b* may including timing, localization, group ID, and other parameters utilized by the audience display device to appropriate determine behavior instance 436*c*. Additionally, persistent storage 434*c* may contain information that can be utilized by run time environment 436*a*, such as a rewards system, or "Kudos." Run time environment 436*a* may access display drivers 438 to communicate with visual output devices as necessary.

FIGS. 1, 2, 3A, 3B, and 4 will now be further described by reference to FIG. 5, which presents flowchart 500 presenting an exemplary method for receiving a macro command for coordinating a visual presentation. With respect to the method outlined in FIG. 5, it is noted that certain details and features have been left out of flowchart 500 in order not to obscure the discussion of the inventive features in the present application.

Figure 5:
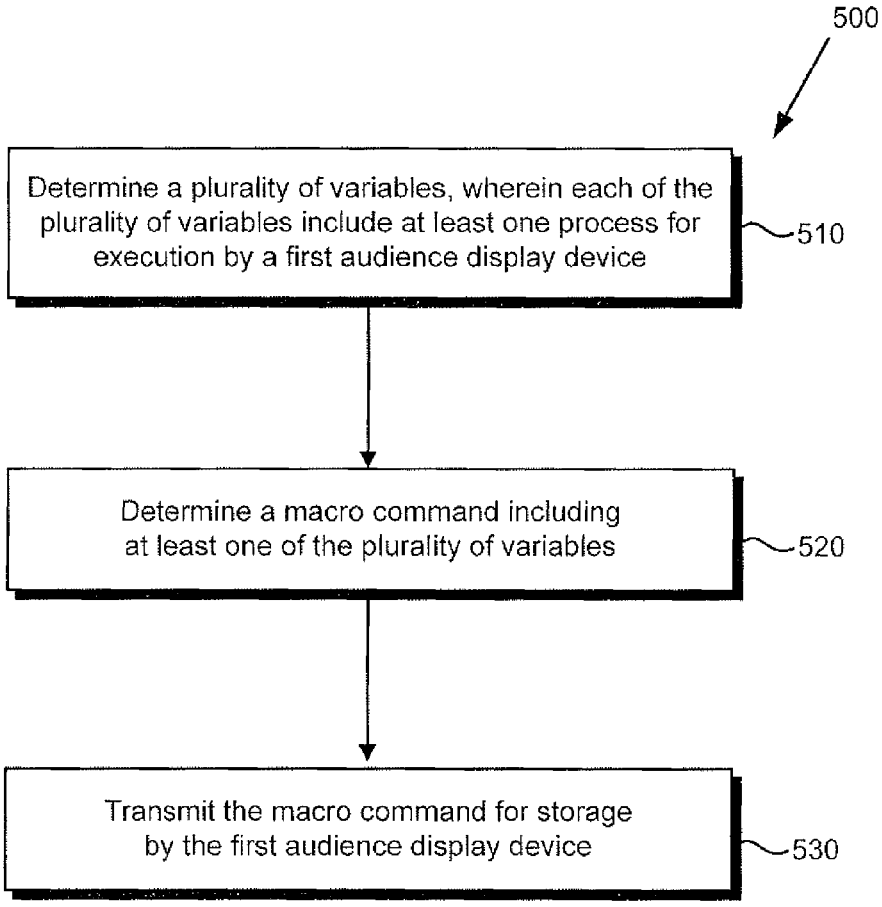
FIG. 5 presents an exemplary flowchart illustrating a method for receiving a macro command for coordinating a visual presentation.

Referring to FIG. 5 in combination with FIG. 1, FIG. 2A, FIG. 2B, FIG. 3A, FIG. 3B, FIG. 3C, and FIG. 4, flowchart 500 begins with determining a plurality of variables 244, wherein each of the plurality of variables 244 include at least one process 242 for execution by a first audience display device 102/202*a-e*/302*c-d*/302*f* (510). The determining may be performed by processor 232 of show controller 220 utilizing macro module 240 with variables 244 and audience display device processes 242. Audience display device processes 242 may correspond to a behavior in behavior component library 430. However, show controller may design audience display device processes utilizing other process codes, such as those contained in color palette 434*a*, parameters 434*b*, and/or persistent storage 434*c*.

The method of flowchart 500 continues with determining a macro command 246 including at least on the plurality of variables 244 (520). The determining may be performed by processor 232 of show controller 220 utilizing macro module 240 with macro commands 246 and variables 244. Processor 232 may utilize variables 244 determined at 510 to create one or a plurality of macro commands 246. Thus, the macro command 246 include at least one variable 244 defining at least one process for execution by audience display device 102/202*a-e*/302*c-d*/302*f*.

Flowchart 500 continues with transmitting the macro command 246 for storage by the first audience display device 102/202*a-e*/302*c-d*/302*f* (530). Show controller 220 may utilize optical emitter 222/222*a-e* to transmit macro command 246. As previously discussed, optical emitters 222/222*a-e* may correspond to an IR emitter utilized to broadcast control messages 251 that include commands to store part of the messages as macro command 246. Additionally, the first audience display device 102/202*a-e*/302*c-d*/302*f* may receive macro command 246 through other means, such as factory preload or using a kiosk. Macro command 246 may be stored in memory 112 of audience display device 102/202*a-e*/302*c-d*/302*f*. Additionally, run time environment 436*a* may keep macro command 246 in persistent storage 434*c* for later recall, such as with a trigger signal, or may place macro command in behavior instance 436*c*.

FIGS. 1, 2A, 2B, 3A, 3B, 3C, and 4 will now be further described by reference to FIG. 6, which presents flowchart 600 presenting an exemplary method for receiving a trigger signal for coordinating a visual presentation. With respect to the method outlined in FIG. 6, it is noted that certain details and features have been left out of flowchart 600 in order not to obscure the discussion of the inventive features in the present application.

Figure 6:
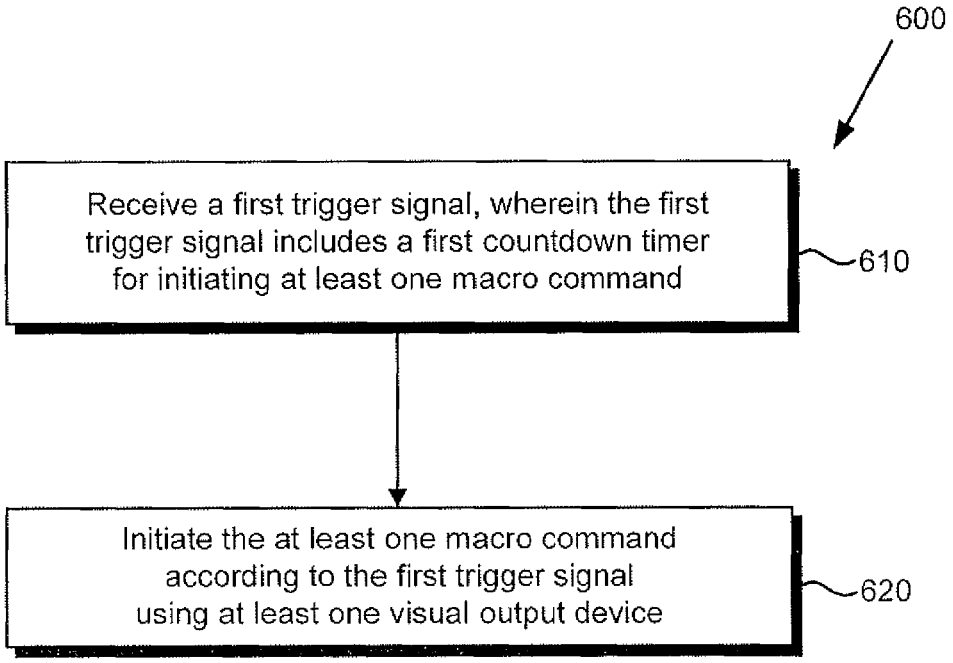
FIG. 6 presents an exemplary flowchart illustrating a method for receiving a trigger signal for coordinating a visual presentation.

Referring to FIG. 6 in combination with FIG. 1, FIG. 2, FIG. 3A, FIG. 3B, and FIG. 4, flowchart 600 begins with receiving a first trigger signal 250, wherein the first trigger signal 250 includes a first countdown timer for at least one macro command 246 (610). The receiving may be performed by processor 111 of control unit 110 utilizing input node 114 to receive a first trigger signal 250, such as event communication 224*a-c*, coordination communication 326, or personalized communication 328, wherein the first trigger signal 250 includes a first countdown timer for at least one macro command 246. As previously discussed, run time environment 436*a* may actively, continuously, or periodically listen to devices, such as input node 114, in order to receive the first trigger signal 250. The first trigger signal 250 may set timer 436*b* of run time environment 436*a*. Macro command 246 may correspond to variables 244 designating audience display device processes 242, such as a behavior in behavior component library 430, as previously discussed. Macro command 246 may also include it's own processes utilizing color palette 434*a*, parameters 434*b*, and/or persistent storage 434*c*. Listener/loader 436*b* may store macro command 246 in dynamically loaded 432*g* or set as behavior instance 436*c*.

Flowchart 600 continues with initiating the at least one macro command according to the first trigger signal using at least one visual output device 118*a*/118*b* (620). Processor 111 of control unit 1110 may perform the initiating the macro command according to the first trigger signal, such as timer 436*b* of run time environment 436*a*. Processor 111 may utilize visual output device 118*a* and/or visual output device 118*b* to perform the initiating the macro command, such as by causing a visual presentation corresponding to the macro command to display on visual output device 118*a*/118*b* according to the first trigger signal. Run time environment 436*a* may determine behavior instance 436*c* in behavior component library 430 from the macro command. Using color palette 434*a*, parameters 434*b*, and persistent storage 434*c*, run time environment 436*a* may perform the behavior by utilizing display drivers 438 to communicate with visual output device 118*a*/118*b*.

Thus, utilizing the above audience display devices, an event venue may coordinate a visual presentation. The visual presentation may encourage audience participation and provide a more immersive and entertaining experience. Furthermore, the performance at the venue can utilize another resource to provide a memorable show.

In one implementation, there is provided a method for use by a first audience display device including a processor and a memory. The method comprises receiving a macro command including at least one variable from a second audience display device, wherein the at least one variable includes at least one process for execution by the first audience display device; and storing the macro command in the memory.

The method further comprises receiving a first trigger signal, wherein the first trigger signal includes a first countdown timer for initiating the macro command; initiating the macro command according to the first trigger signal using at least one visual output device.

Prior to the initiating the macro command according to the first trigger signal, the method may further comprise receiving a second trigger signal after the first trigger signal, wherein the second trigger signal includes a second countdown timer for the macro command, and wherein the second countdown timer includes the first countdown timer modified to account for a time difference between the receiving the first trigger signal and the receiving the second trigger signal.

The second trigger signal may supersede the first trigger signal. The at least one process may further correspond to a visual presentation for execution by the first audience display device. The visual presentation may correspond to a shut off presentation. The receiving the macro command may comprise receiving the macro command using a control message from a second audience display device, where the macro command is specific to the first audience display device and the second audience display device.

The macro command may he localized to an area, where the macro command further includes a time offset for each of the at least one variable corresponding to the area.

In another implementation, there is provided a method for use by a first audience display device including a processor and a memory. The method comprises receiving a first trigger signal, wherein the first trigger signal includes a first countdown timer for initiating at least one macro command; initiating the at least one macro command according to the first trigger signal using at least one visual output device.

Prior to the initiating the at least one macro command according to the first trigger signal, the method may further comprise receiving a second trigger signal after the first trigger signal, wherein the second trigger signal includes a second countdown timer for the at least one macro command, and wherein the second countdown timer includes the first countdown timer modified to account for a time difference between the receiving the first trigger signal and the receiving the second trigger signal. The second trigger signal may supersede the first trigger signal.

Prior to the receiving the first trigger signal, the method may further comprise receiving a macro command including at least one variable, wherein the at least one variable includes at least one process for execution by the first audience display device; and storing the macro command in the memory. The at least one process may produce a visual effect on the at least one visual output device.

The method may further comprise returning to an idle state after completion of the at least one macro command, where the receiving the first trigger signal further comprises receiving the first trigger signal using an optical sensor, where the receiving the first trigger signal comprising receiving the first trigger signal from a second audience display device, and where one of the trigger signal and the macro command is localized to an area In yet another implementation, a device comprises an optical sensor; an optical emitter; at least one visual output device; a power unit; and a control unit, the control unit including a processor and a memory, where the control unit is configured to receive a first macro command including at least one variable, wherein the at least one variable includes at least one process for execution by the first audience display device; and store the first macro command in the memory. The at least one visual output device may comprise a light emitting diode.

The device may further comprise an ambient light sensor; and wherein the control unit is further configured to produce a second visual effect using the at least one visual output device in response to a threshold ambient light level.

Prior to the control unit receiving the trigger signal using the optical sensor, the control unit may be further configured to receive a first trigger signal, wherein the first trigger signal includes a first countdown timer for initiating the macro command; initiate the macro command according to the first trigger signal using at least one visual output device.

Prior to the initiating the macro command according to the first trigger signal, the device may receive a second trigger signal after the first trigger signal, where the second trigger signal includes a second countdown timer for the macro command, where the second countdown timer includes the first countdown timer modified to account for a time difference between the receiving the first trigger signal and the receiving the second trigger signal, and where the second trigger signal supersedes the first trigger signal.

In another implementation, a device comprises an optical emitter; a power unit; and control unit, the control unit including a processor and a memory, the control unit is configured to transmit a first macro command including at least one variable, wherein the at least one variable includes at least one process for execution by a first audience display device. The device may be configured as a toy, and may further comprise at least one visual output device, where the control unit is further configured to produce a visual effect on the at least one visual output device.

From the above description it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. A method for use by a system including a system processor and a system memory, the method comprising:

selecting, from the system memory using the system processor, a plurality of variables, wherein the plurality of variables include instructions for execution by a processor of a first audience display device;

generating, using the system processor, a macro command including the plurality of variables; and transmitting the macro command for storage by the first audience display device to provide the instructions for execution by the processor of the first audience display device.

2. The method of claim 1, wherein the instructions correspond to a visual presentation for execution by the processor of the first audience display device.

3. The method of claim 2, wherein the visual presentation corresponds to a shut off presentation.

4. The method of claim 1, wherein the transmitting the macro command comprises transmitting the macro command using a control message using infrared.

5. The method of claim 1, wherein the transmitting the macro command comprising transmitting the macro command using a control message from a second audience display device.

6. The method of claim 5, wherein the macro command is specific to the first audience display device and the second audience display device.

7. The method of claim 1, wherein the macro command is localized to an area.

8. The method of claim 7, wherein the macro command further includes a time offset for each of the plurality of variables corresponding to the area.

9. A system comprising:

a control unit, the control unit including a system processor and a system memory, the system processor configured to:

select, from the system memory, a plurality of variables, wherein the plurality of variables include instructions for execution by a processor of a first audience display device;

generate a macro command including the plurality of variables; and a transmission unit, under the control of the system processor, configured to:

transmit the macro command for storage by the first audience display device to provide the instructions for execution by the processor of the first audience display device.

10. The system of claim 9, wherein the instructions further correspond to a visual presentation for execution by the processor of the first audience display device.

11. The system of claim 10, wherein the visual presentation corresponds to a shut off presentation.

12. The system of claim 9, wherein the control unit is further configured to:

transmit a first trigger signal, wherein the first trigger signal includes a first countdown timer for the initiating the macro command.

13. The system of claim 12, wherein the control unit is further configured to:

transmit a second trigger signal, wherein the second trigger signal includes a second countdown timer for initiating the macro command by the first audience display device, and wherein the second countdown timer is the first countdown timer modified to account for a time difference between the receiving the first trigger signal and the receiving the second trigger signal by the first audience display device.

14. The system of claim 13, wherein the second trigger signal supersedes the first trigger signal.

15. The system of claim 14, wherein the second trigger signal is transmitted prior to an expiration of the first countdown timer.

16. The system of claim 9, wherein the macro command is specific to the first audience display device.

17. The method of claim 9, wherein the macro command is localized to an area, and wherein the macro command further includes a time offset for each of the plurality of variables corresponding to the area.

18. A method for use by a system including a system processor and a system memory, the method comprising:

selecting, from the system memory using the system processor, a plurality of variables, wherein the plurality of variables include instructions for execution by a processor of a first audience display device;

generating, using the system processor, a macro command including the plurality of variables;

transmitting the macro command for storage by the first audience display device to provide the instructions for execution by the processor of the first audience display device;

transmitting a first trigger signal, wherein the first trigger signal includes a first countdown timer for the initiating the macro command by the first audience display device; and transmitting a second trigger signal, wherein the second trigger signal includes a second countdown timer for initiating the macro command by the first audience display device, and wherein the second countdown timer is the first countdown timer modified to account for a time difference between the receiving of the first trigger signal and the of receiving the second trigger signal by the first audience display device.

19. The method of claim 18, wherein the second trigger signal supersedes the first trigger signal.

20. The method of claim 18, wherein the second trigger signal is transmitted prior to an expiration of the first countdown timer.

* * * * *